US012179250B2

(12) United States Patent
Nomura et al.

(10) Patent No.: US 12,179,250 B2
(45) Date of Patent: Dec. 31, 2024

(54) DIE

(71) Applicant: NIPPON STEEL CORPORATION, Tokyo (JP)

(72) Inventors: Naruhiko Nomura, Tokyo (JP); Toshiya Suzuki, Tokyo (JP); Kenta Uenishi, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 197 days.

(21) Appl. No.: 17/795,390

(22) PCT Filed: Mar. 19, 2021

(86) PCT No.: PCT/JP2021/011336

§ 371 (c)(1),
(2) Date: Jul. 26, 2022

(87) PCT Pub. No.: WO2021/193415

PCT Pub. Date: Sep. 30, 2021

(65) Prior Publication Data

US 2023/0150006 A1 May 18, 2023

(30) Foreign Application Priority Data

Mar. 26, 2020 (JP) ..... 2020-055216

(51) Int. Cl.
*B21D 37/10* (2006.01)
*B21D 37/16* (2006.01)

(52) U.S. Cl.
CPC ..... *B21D 37/10* (2013.01); *B21D 37/16* (2013.01)

(58) Field of Classification Search
CPC ..... B21D 37/10; B21D 37/16; B21D 22/201; B21D 22/022; B21D 24/16
See application file for complete search history.

(56) References Cited

U.S. PATENT DOCUMENTS 8,047,037 B2 11/2011 Vehof et al.
2013/0111965 A1 5/2013 Lee
(Continued)

FOREIGN PATENT DOCUMENTS

JP 2006-198666 A 8/2006
JP 2007-136535 A 6/2007
(Continued)

*Primary Examiner* — Teresa M Ekiert
(74) *Attorney, Agent, or Firm* — Birch, Stewart, Kolasch & Birch, LLP

(57) ABSTRACT

The die includes a die base, a die body, and an opening/closing member. In the die base, a storage portion for storing refrigerant is formed. The die body includes a mounting surface, a forming surface, and a plurality of flow channels. The mounting surface is located on the storage portion side of the die base. The forming surface is located on the opposite side of the mounting surface. The flow channels pass through the die body from the mounting surface to the forming surface. The opening/closing member is disposed between the die base and the die body. The opening/closing member includes a plurality of through holes corresponding to the plurality of flow channels. The opening/closing member is configured to be movable with respect to the die base and the die body such that each of the through holes brings the corresponding flow channel and the storage portion into communication.

10 Claims, 14 Drawing Sheets

(56) References Cited

U.S. PATENT DOCUMENTS

| | | | | |
|---|---|---|---|---|
| 2014/0069162 | A1 | 3/2014 | Fukuchi et al. | |
| 2018/0021833 | A1* | 1/2018 | Suzuki | B21D 37/16 72/342.4 |
| 2019/0100816 | A1* | 4/2019 | Seki | B21D 22/20 |

FOREIGN PATENT DOCUMENTS

| | | | |
|---|---|---|---|
| JP | 2013-99774 | A | 5/2013 |
| KR | 10-2020-0020151 | A | 2/2020 |
| WO | WO 2012/161192 | A1 | 11/2012 |

* cited by examiner

DIE

TECHNICAL FIELD

The present disclosure relates to a die, more specifically, a die used for hot pressing.

BACKGROUND ART

As a method for forming high-strength parts such as automobile body parts, hot pressing has been known. In the hot pressing, a heated blank is pressed with dies attached to a press machine, and thereafter the formed article is cooled and quenched in the dies. The formed article is cooled, for example, by refrigerant ejected from the forming surface of a die.

Patent Literature 1 discloses a die having a refrigerant ejection function. In this die, a plurality of refrigerant supply tubes that pass through the inside and open at the forming surface are located. Each of the refrigerant supply tubes is provided with an opening/closing valve, a flow rate regulating valve, and a pressure regulating valve. By controlling these valves, parameters such as an ejection amount, an ejection flow rate, an ejection pressure, an ejection time, an ejection timing, and the like of the refrigerant from the refrigerant supply tubes are controlled.

In the die of Patent Literature 1, valves for controlling the ejection of the refrigerant are provided in each of the refrigerant supply tubes. Therefore, when cooling the formed article, it is necessary to control the plurality of valves at the same time, thus the problem is that the ejection control of refrigerant is complicated.

On the other hand, the die disclosed in Patent Literature 2 includes a die body including a forming surface and a refrigerant container to be housed inside the die body. The die body is provided with a plurality of die supply holes that open at the forming surface. A plurality of container supply holes are provided on the wall portion of the refrigerant container. As a result of the refrigerant container being moved up and down or rotated in the die body, each of the container supply holes and a die supply hole are brought into a communication state or a non-communication state. When the container supply hole and the die supply hole come into communication with each other, the refrigerant is supplied from the refrigerant container to the formed article on the forming surface through the container supply hole and the die supply hole.

CITATION LIST

Patent Literature

Patent Literature 1: Japanese Patent Application Publication No. 2006-198666

Patent Literature 2: Japanese Patent Application Publication No. 2007-136535

SUMMARY OF INVENTION

Technical Problem

In the die of Patent Literature 2, by bringing the container supply hole and the die supply hole into communication by moving up and down or rotating the refrigerant container, it is possible to supply refrigerant to the formed article without performing complicated ejection control by a plurality of valves. However, in Patent Literature 2, since the refrigerant container is disposed inside the die body, it is necessary to form a cavity inside the die body. Therefore, the problem is that the strength of the die decreases.

An objective of the present disclosure is to provide a die that can secure strength and easily supply refrigerant to a formed article.

Solution to Problem

The die according to the present disclosure includes a die base, a die body, and an opening/closing member. In the die base, a storage portion for storing refrigerant is formed. The die body is mounted to the die base. The die body includes a mounting surface, a forming surface, and a plurality of flow channels. The mounting surface is located on the storage portion side of the die base. The forming surface is located on the opposite side to the mounting surface. The plurality of flow channels pass through the die body from the mounting surface toward the forming surface. The opening/closing member is disposed between the die base and the die body. The opening/closing member includes a plurality of through holes corresponding to the plurality of flow channels. The opening/closing member is configured to be movable with respect to the die base and the die body such that each of the through holes brings the corresponding flow channel and the storage portion into communication.

Advantageous Effects of Invention

The die according to the present disclosure can secure strength and easily supply refrigerant to a formed article.

DESCRIPTION OF EMBODIMENTS

Figure 1:
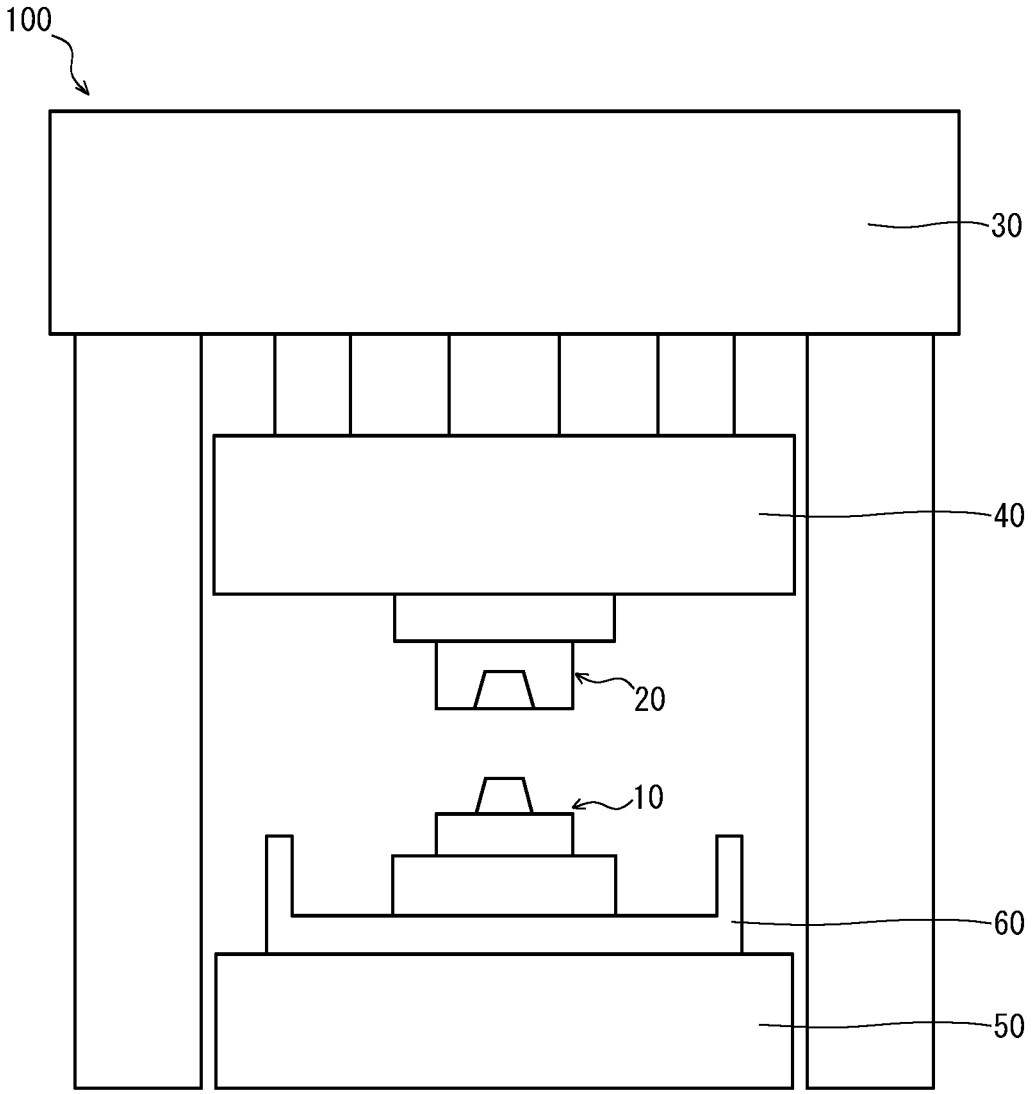
FIG. 1 is a schematic diagram showing a press machine.

The die according to an embodiment includes a die base, a die body, and an opening/closing member. In the die base, a storage portion for storing refrigerant is formed. The die body is mounted to the die base. The die body includes a mounting surface, a forming surface, and a plurality of flow channels. The mounting surface is located on the storage portion side of the die base. The forming surface is located on the opposite side to the mounting surface. The plurality of flow channels pass through the die body from the mounting surface toward the forming surface. The opening/closing member is disposed between the die base and the die body. The opening/closing member includes a plurality of through holes corresponding to the plurality of flow channels. The opening/closing member is configured to be movable with respect to the die base and the die body such that each of the through holes brings the corresponding flow channel and the storage portion into communication (first configuration).

In the first configuration, the storage portion for storing refrigerant is formed in the die base. Therefore, since it is not necessary to provide a large cavity for storing refrigerant in the die body including the forming surface, the strength of the die can be secured. Further, in the first configuration, an opening/closing member is disposed between the die base and the die body. A plurality of through holes are formed in the opening/closing member corresponding to the plurality of flow channels provided in the die body. In order to bring the flow channels of the die body and the storage portion of the die base into communication, simply this opening/closing member may be moved. In other words, moving the opening/closing member will result in communication between each flow channel of the die body and the storage portion of the die base through the plurality of through holes provided in the opening/closing member so that the refrigerant in the storage portion is ejected from the forming surface through each flow channel of the die body. Therefore, according to the first configuration, it is possible to easily supply refrigerant to a formed article without performing complicated control by a plurality of valves.

In the first configuration, it is preferable that the opening/closing member has a plate shape and is slidable with respect to the die base and the die body (second configuration).

According to the second configuration, by sliding the plate-shaped opening/closing member, it is possible to move all through holes, thereby bringing the plurality of flow channels of the die body and the storage portion of the die base into communication. Further, since the plurality of through holes can be efficiently provided on one opening/closing member, it is possible to efficiently perform ejection control of refrigerant from the plurality of flow channels.

In the second configuration, the plurality of through holes may include a first through hole and a second through hole. In the sliding direction of the opening/closing member, and/or a direction perpendicular to the sliding direction, the width of the second through hole is larger than the width of the first through hole (third configuration).

The time for which a flow channel of the die body and the storage portion of the die base are in communication, that is, the time for which refrigerant from the storage portion is supplied to the formed article through the flow channel, is determined mainly according to the width of the corresponding through hole in the sliding direction of the opening/closing member. The flow rate per unit time of the refrigerant supplied to the formed article is mainly determined according to the width of the through hole in the direction perpendicular to the sliding direction of the opening/closing member. According to the third configuration, the width in the sliding direction and/or a direction perpendicular to the sliding direction is different between the first through hole and the second through hole. Therefore, the supply time of the refrigerant and/or the flow rate per unit time of the supplied refrigerant can be changed between the flow channel corresponding to the first through hole and the flow channel corresponding to the second through hole. Therefore, it is possible to appropriately set the cooling time, cooling speed, and the like for each region of the formed article.

In the second or third configuration, the opening/closing member may slide in two axial directions with respect to the die base and the die body (fourth configuration).

In a case in which the plate-shaped opening/closing member slides only in a single axial direction, when the communication state and the non-communication state between the flow channel of the die body and the storage portion of the die base are switched, the opening/closing member is simply moved back and forth. For example, when the opening/closing member is slid to one side in the above described axial direction, the through hole of the opening/closing member overlaps the flow channel of the die body, and the flow channel and the storage portion are brought into a communication state. If the opening/closing member is further slid, the through hole of the opening/closing member passes the flow channel of the die body, and deviates from the flow channel so that the flow channel and the storage portion are brought into a non-communication state. Thereafter, since the opening/closing member follows the same path to return to the original position, the flow channel and the storage portion are brought into a communication state again until the opening/closing member returns to the original position. In contrast to this, according to the fourth configuration, since the opening/closing member which has been slid in one axial direction and has reached the end point via a communication state and a non-communication state can be slid in another axial direction, the opening/closing member can be returned to its original position in a path different from the outbound path. Therefore, it is possible to prevent the flow channel and the storage portion, which has once been brought into a non-communication state, from being brought into a communication state again. In other words, the opening/closing member can be returned to the initial position while stopping the supply of refrigerant to the formed article.

In any of the first to fourth configurations, the die base may have a plurality of grooves at the surface. The plurality of grooves are in communication with each other and configure the storage portion (fifth configuration).

According to the fifth configuration, the storage portion is configured by a plurality of grooves provided at the surface of the die base. Therefore, for example, the storage amount of refrigerant in the storage portion can be reduced compared with the case where the storage portion is a single concave portion. Therefore, in particular, when supply of refrigerant to the storage portion is started in a state in which the storage portion is not filled with refrigerant, it is possible to reduce the time from when supply of refrigerant to the storage portion of the die base is started until when the refrigerant is stored in the storage portion allowing the refrigerant to flow into each flow channel of the die body. Further, by configuring the storage portions by the plurality of grooves being in communication with each other, it is possible to integrate piping systems to be connected to the die base, thereby allowing the diameter of the pipe connected to the die base to be expanded. Therefore, the pressure loss of the refrigerant to be supplied to the storage portion can be suppressed. Furthermore, it is possible to compensate for the decrease in the flow rate of refrigerant in the communication portion between the flow channel and the storage portion of the die body, and the flow rate of refrigerant ejected from the forming surface through the flow channel can be stabilized.

Hereinafter, embodiments of the present disclosure will be described with reference to the drawings. The same or equivalent configuration is given the same reference signal in each figure, and the same description will not be repeated.

First Embodiment

[Configuration of Press Machine 100]

FIG. 1 is a schematic diagram showing a press machine 100. The press machine 100 is provided with dies 10 and 20. FIG. 1 is a diagram to show the press machine 100 viewed from the front. In the present embodiment, the direction perpendicular to the paper surface of FIG. 1 is referred to as a depth direction of the press machine 100.

The press machine 100 includes a main body frame 30, a slide 40, a bolster 50, and a base plate 60.

The slide 40 is mounted to the main body frame 30. The slide 40 moves up and down with respect to the main body frame 30 by operation of a hydraulic cylinder, a flywheel, or the like housed in the main body frame 30. The slide 40 holds the die 20.

The bolster 50 is disposed below the slide 40. The base plate 60 is fixed onto the bolster 50. The base plate 60 has a concave shape. The die 10 is mounted to the base plate 60. The base plate 60 adjusts the position of the die 10 in the vertical direction. The die 10 faces the die 20.

Figure 2:
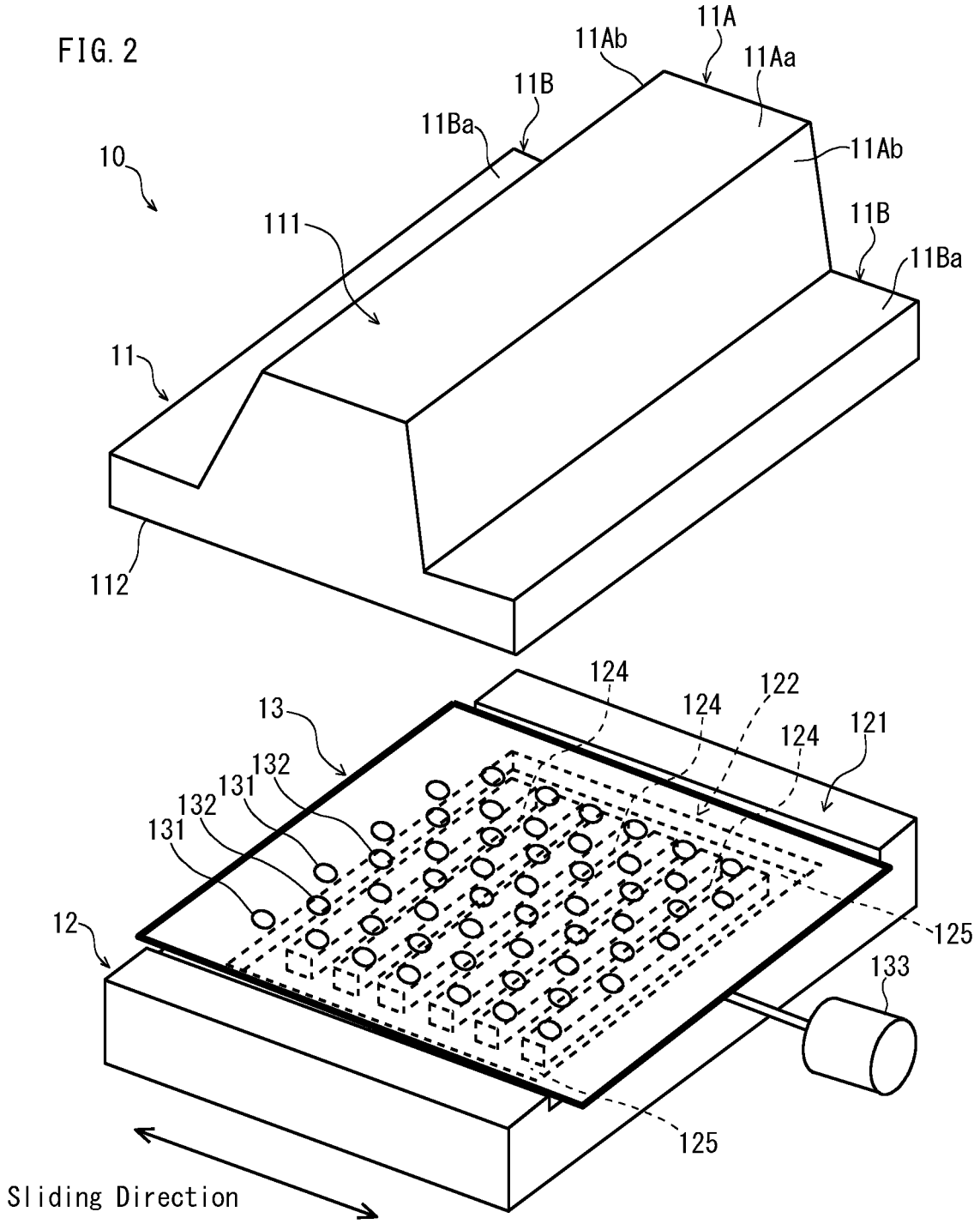
FIG. 2 is an exploded view of a die according to a first embodiment.

The die 10 extends in the depth direction of the press machine 100. Hereinafter, with respect to the die 10, the depth direction of the press machine 100 is referred to as the longitudinal direction, and the direction perpendicular to the longitudinal direction and the vertical direction is referred to as a lateral direction. FIG. 2 is an exploded view of the die 10. The die 10 includes a die body 11, a die base 12, and an opening/closing member 13.

The die body 11 includes a forming surface 111 and a mounting surface 112. The forming surface 111 is the upper surface of the die body 11. The mounting surface 112 is located on the opposite side of the forming surface 111. In other words, the mounting surface 112 is the lower surface of the die body 11. The mounting surface 112 is generally flat.

In the present embodiment, the die body 11 has an approximate hat shape as viewed from the longitudinal direction. In other words, the die body 11 includes a punch part 11A and flange parts 11B.

The punch part 11A is disposed at the middle in the lateral direction of the die body 11. The punch part 11A includes a top surface 11Aa and side surfaces 11Ab. The side surfaces 11Ab are located on both sides of the top surface 11Aa. Each of the side surfaces 11Ab is inclined with respect to the vertical direction outward in the lateral direction as they are closer to the bottom from the top surface 11Aa. On the lower surface of the die 20 (FIG. 1), a concave portion corresponding to the punch part 11A is formed.

Each flange part 11B protrudes outward in the lateral direction from the punch part 11A. The upper surface 11Ba of the flange part 11B is connected to the lower end of the side surface 11Ab of the punch part 11A. The top surface 11Aa and the side surfaces 11Ab of the punch part 11A, and the upper surface 11Ba of each flange part 11B constitute the forming surface 111 of the die body 11.

Figure 3:
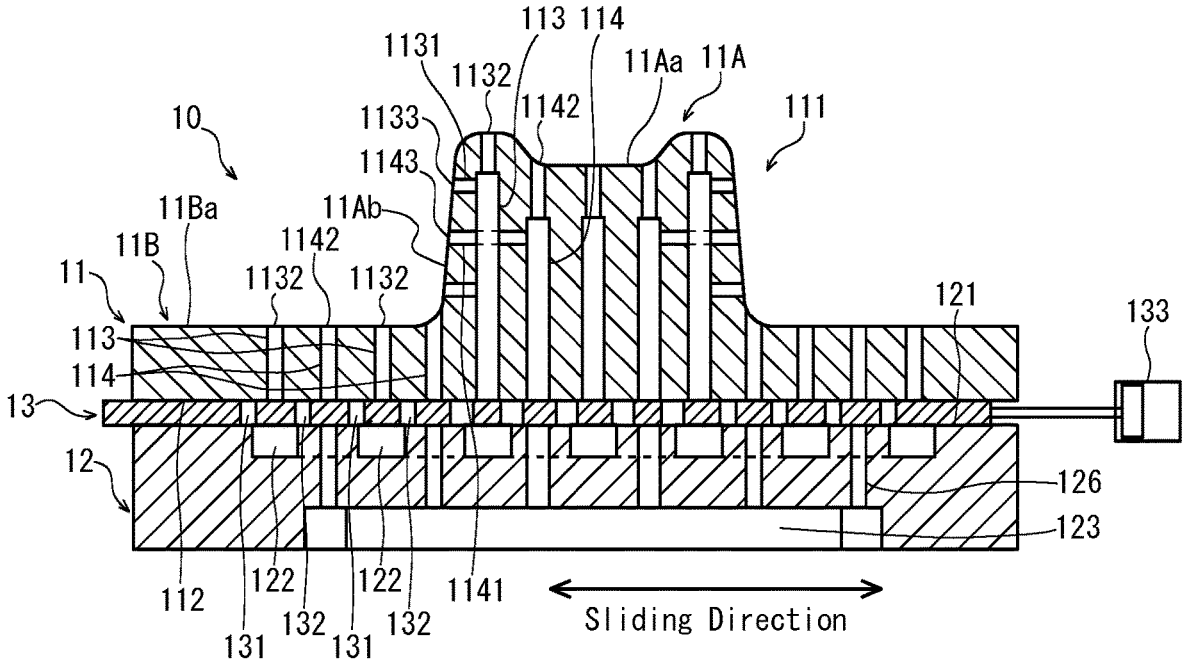
FIG. 3 is a sectional view in a plane perpendicular to the longitudinal direction of the die in a non-communication state.

FIG. 3 is a cross-section (a sectional view in a plane perpendicular to the longitudinal direction) of the die 10. Referring to FIG. 3, the die body 11 further includes a plurality of flow channels 113. In the example of the present embodiment, the plurality of flow channels 113 are arranged at equal intervals in the longitudinal direction in the die body 11. Further, the flow channels 113 are also arranged at equal intervals in the lateral direction of the die body 11. However, the plurality of flow channels 113 may not be arranged at equal intervals in the longitudinal or lateral direction of the die body 11. Each of the flow channels 113 passes through the die body 11 from the mounting surface 112 to the forming surface 111. The flow channel 113 extends in the vertical direction in the die body 11. The flow channel 113 may include a branch flow channel 1131 extending in the lateral direction. The lower end of the flow channel 113 opens at the mounting surface 112. The upper end 1132 of the flow channel 113 and the front end 1133 of the branch flow channel 1131 open at the forming surface 111.

More specifically, the upper ends 1132 of the flow channels 113 open at the top surface 11Aa of the punch part 11A and the upper surfaces 11Ba of the flange parts 11B. The front end 1133 of the branch flow channel 1131 opens at the side surface 11Ab of the punch part 11A. The sectional shape of each flow channel 113 is, for example, circular. However, the flow channel 113 may have a sectional shape other than a circle. The sectional area of each flow channel 113 may be different from or the same as each other. For example, the sectional area of the flow channel 113 in the punch part 11A is larger than the sectional area of the flow channel 113 in the flange part 11B. Each branch flow channel 1131 is provided in a flow channel 113 located near either of the side surfaces 11Ab, among the flow channels 113 in the punch part 11A. The sectional area of each branch flow channel 1131 may also be different from or the same as each other.

A plurality of flow channels 114 separate from the flow channels 113 are also formed in the die body 11. In the example of the present embodiment, the plurality of flow channels 114 are arranged at equal intervals in the longitudinal direction in the die body 11. Further, the flow channels 114 are also arranged at equal intervals in the lateral direction of the die body 11. However, the plurality of flow channels 114 may not be arranged at equal intervals in the longitudinal direction or the lateral direction of the die body 11. Each of the flow channels 114 passes through the die body 11 from the mounting surface 112 toward the forming surface 111. The flow channel 114 extends in the vertical direction in the die body 11. The flow channel 114 may include a branch flow channel 1141 extending in the lateral direction. The lower end of the flow channel 114 opens at the mounting surface 112. The upper end 1142 of the flow channel 114 and the front end 1143 of the branch flow channel 1141 open at the forming surface 111.

More specifically, the upper ends 1142 of the flow channels 114 open at the top surface 11Aa of the punch part 11A and the upper surfaces 11Ba of the flange parts 11B. The front end 1143 of the branch flow channel 1141 opens at the side surface 11Ab of the punch part 11A. The sectional shape of each flow channel 114 is, for example, circular. However, the flow channel 114 may have a sectional shape other than a circle. The sectional area of each flow channel 114 may be different from or the same as each other. For example, the sectional area of the flow channel 114 in the punch part 11A is larger than the sectional area of the flow channel 114 in the flange part 11B. The branch flow channel 1141 is provided in a flow channel 114 in the punch part 11A. The sectional area of each branch flow channel 1141 may also be different from or the same as each other.

The die base 12 is disposed below the die body 11. The die body 11 is mounted to the die base 12. The die base 12 has a substantially cuboid shape. A concave-shaped storage portion 122 is formed at the surface 121 on the die body 11 side of the die base 12. The refrigerant is stored in the storage portion 122. At the surface opposite to the surface 121, a concave-shaped discharge portion 123 is formed in order to discharge the refrigerant after use. The die base 12 also has a through path 126 extending from the discharge portion 123 toward the surface 121.

Referring to FIG. 2 again, the die base 12 has a plurality of grooves 124 and 125 configuring the storage portion 122, at the surface 121. The plurality of grooves 124 respectively extend in the longitudinal direction, viewed from above, that is, in a plan view of the die base 12. In the example of the present embodiment, the grooves 124 are located in parallel to each other. However, each groove 124 may be inclined with respect to other grooves 124. FIG. 2 shows a case where the storage portion 122 has seven grooves 124. The grooves 124 are located, for example, at equal intervals in the lateral direction. However, the grooves 124 may be located at unequal intervals. The width, depth, and length of each groove 124 are preferably the same. One ends of the grooves 124 are connected by a groove 125 extending in the lateral direction. The other ends of the grooves 124 are connected by another groove 125 extending in the lateral direction. In other words, the plurality of grooves 124 and 125 are in communication with each other.

The storage portion 122 is disposed at the middle part in the longitudinal direction at the surface 121 of the die base 12. The middle part is slightly recessed compared with other portions.

The opening/closing member 13 is placed on the concave-shaped middle part at the surface 121 of the die base 12. The opening/closing member 13 has a solid plate-shape. The opening/closing member 13 has, for example, a substantially rectangular shape in a plan view. The opening/closing member 13 is a member separate from the die body 11, and is disposed outside the die body 11. More specifically, the opening/closing member 13 is disposed between the die base 12 and the die body 11. The opening/closing member 13 is sandwiched by the mounting surface 112 of the die body 11 and the surface (upper surface) 121 of the die base 12. It is preferable that a sealant not shown is disposed between the lower surface of the opening/closing member 13 and the surface 121 of the die base 12, and between the upper surface of the opening/closing member 13 and the mounting surface 112 of the die body 11.

The opening/closing member 13 includes a plurality of through holes 131 and a plurality of through holes 132. The plurality of through holes 131 are arranged in the longitudinal direction and the lateral direction of the die 10. The plurality of through holes 132 are also arranged in the longitudinal direction and the lateral direction of the die 10. In the example of the present embodiment, a through hole 132 is arranged between longitudinal rows and between lateral rows of the through holes 131. The through holes 132 are located so as to be deviated in position from the through holes 131 in the longitudinal direction and the lateral direction. However, the arrangement of the through holes 131 and 132 is not limited to this and can be determined appropriately.

The plurality of through holes 131 are formed in the opening/closing member 13 corresponding to the plurality of flow channels 113 (FIG. 3) of the die body 11. For example, the through holes 131 are arranged at the same interval as that of the flow channels 113 in the longitudinal direction of the die 10. For example, the through holes 131 are arranged at the same interval as that of the flow channels 113 even in the lateral direction of the die 10. In the present embodiment, the number of through holes 131 is the same as that of flow channels 113. However, the number of through holes 131 may be different from the number of flow channels 113.

The plurality of through holes 132 are formed in the opening/closing member 13 corresponding to the plurality of flow channels 114 (FIG. 3) of the die body 11. For example, the through holes 132 are arranged at the same interval as that of the flow channels 114 in the longitudinal direction of the die 10. For example, the through holes 132 are arranged at the same interval as that of the flow channels 114 even in the lateral direction of the die 10. In the present embodiment, the number of through holes 132 is the same as that of flow channels 114. However, the number of through holes 132 may be different from the number of flow channels 114. Each of the through holes 132 brings the corresponding flow channel 114 and the discharge portion 123 of the die base 12 into communication.

In the example of the present embodiment, each of the through holes 131 and 132 has a circular shape. However, each of the through holes 131 and 132 may not have a circular shape. Each of the through holes 131 and 132 may have, for example, a semi-circular, elliptic, semi-elliptic, or polygonal shape. Further, the opening area of each of the through holes 131 and 132 may be different from or the same as each other.

The opening/closing member 13 is configured to be movable with respect to the die base 12 and the die body 11 such that each of the through holes 131 brings the corresponding flow channel 113 and the storage portion 122 into communication. A driving unit 133 is mounted to the opening/closing member 13. For example, the driving unit 133 is an actuator such as a hydraulic cylinder, an electric slider, or the like. The driving unit 133 causes the opening/closing member 13 to slide in the lateral direction.

[Operation of Press Machine 100]

Next, the operation of a press machine 100 when producing a formed article will be described. Referring to FIG. 1, first, a heated blank (not illustrated) is placed on the die 10. Next, the die 20 is lowered by lowering the slide 40. Thereby, the blank is pressed by the die 20 and the die 10. After the die 20 reaches the bottom dead center, refrigerant is ejected from the forming surface of the die 10, and the formed article (not illustrated) is cooled in the dies 10 and 20.

Figure 4:
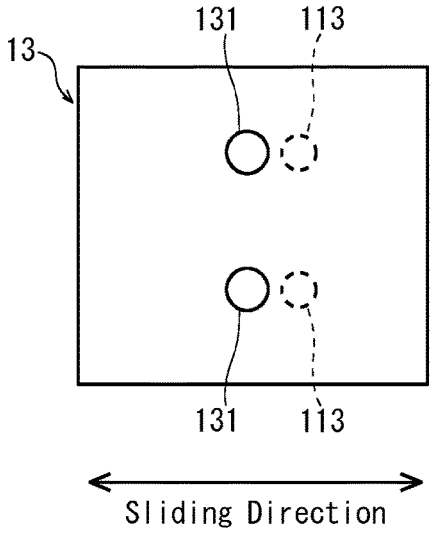
FIG. 4 is a schematic diagram for explaining overlapping between a through hole of an opening/closing member and a flow channel of a die body in a non-communication state.
Figure 5:
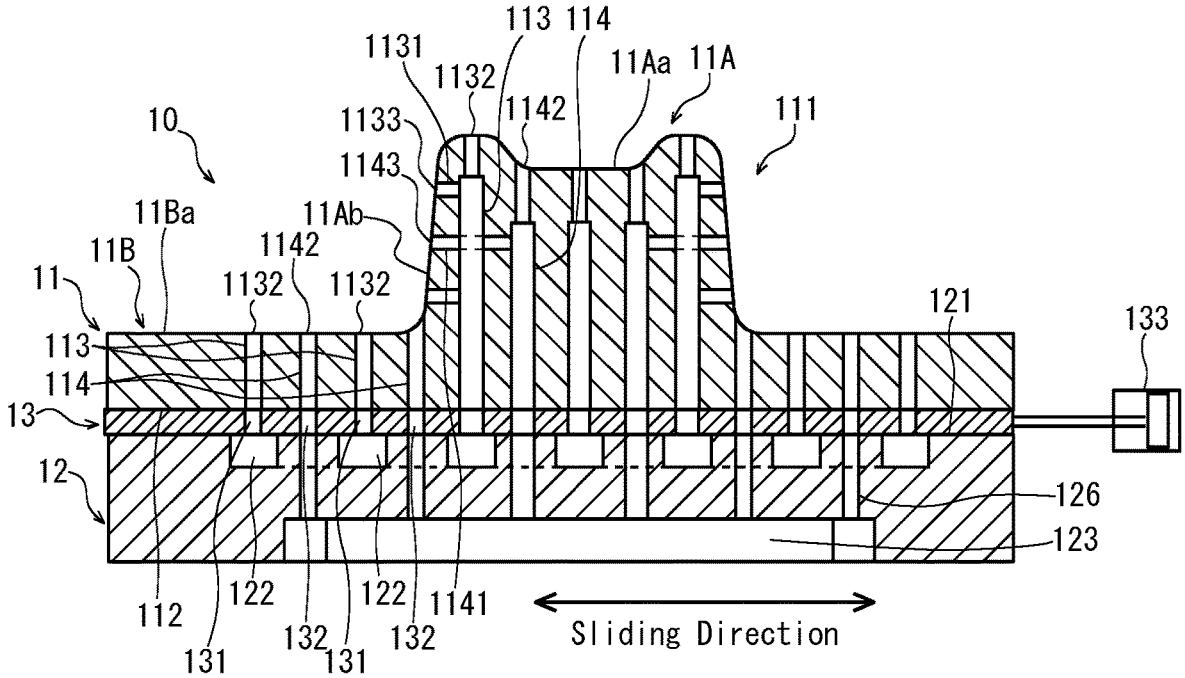
FIG. 5 is a sectional view in a plane perpendicular to the longitudinal direction of the die in a communication state.
Figure 6:
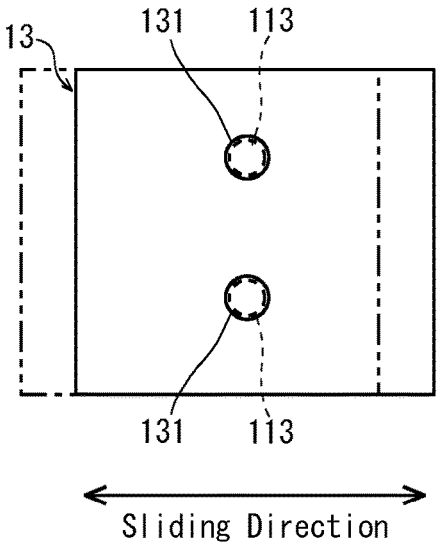
FIG. 6 is a schematic diagram for explaining overlapping between a through hole of the opening/closing member and a flow channel of the die body in a communication state.

Referring to FIGS. 3 to 6, the operation of the die 10 when cooling the formed article will be described. FIGS. 3 and 4 are diagrams showing the positional relationship between the die body 11 and the die base 12, and the opening/closing member 13 before the start of cooling. FIGS. 5 and 6 are diagrams showing the positional relationship between the die body 11 and the die base 12, and the opening/closing member 13 during cooling. In FIG. 6, the original position of the opening/closing member 13 is shown by a phantom line. FIGS. 3 and 5 are cross-sectional views of the die 10. FIGS. 4 and 6 are diagrams to show the opening/closing member 13 when viewed from below, in which a part of the opening/closing member 13 is enlarged to be shown.

Referring to FIG. 3, in order to cool the formed article, refrigerant pressure feeding means provided outside the die 10 is driven, and refrigerant is supplied to the storage portion 122 to be stored. Examples of the refrigerant pressure feeding means include a pressure feed pump or cylinder disposed between the storage portion 122 and a refrigerant tank (not illustrated). The refrigerant pressure feeding means may be a water supply directly connected to the storage portion 122. Further, refrigerant suction means such as a suction pump (not illustrated) connected to the discharge portion 123 of the die base 12 is driven. The refrigerant pressure feeding means and the refrigerant suction means are preferably driven before press working is started. As a result, before starting cooling of the formed article, the storage portion 122 is filled with refrigerant and is pressurized, and the discharge portion 123 becomes a negative pressure state.

As shown in FIGS. 3 and 4, before starting the cooling of the formed article, the through holes 131 of the opening/closing member 13 are deviated from the flow channels 113 of the die body 11. The opening/closing member 13 is disposed such that each through hole 131 does not overlap the corresponding flow channel 113. Therefore, a portion other than the through holes 131 of the opening/closing member 13 block the lower ends of the flow channels 113. In other words, the storage portion 122 of the die base 12 and the flow channels 113 of the die body 11 are not in communication with each other. Moreover, the discharge portion 123 of the die base 12 and the flow channels 114 of the die body 11 are not in communication with each other.

In this state, the driving unit 133 is operated to cause the opening/closing member 13 to slide. In other words, as shown in FIGS. 5 and 6, the opening/closing member 13 is moved to one side in the sliding direction such that the through holes 131 of the opening/closing member 13 overlap the flow channels 113 of the die body 11. Thereby, the storage portion 122 of the die base 12 and the flow channels 113 of the die body 11 are brought into communication with each other. At this time, the through holes 132 of the opening/closing member 13 also overlap the flow channels 114 of the die body 11. Thereby, the discharge portion 123 and the through paths 126 of the die base 12 are brought into communication with the flow channels 114 of the die body 11.

In the example shown in FIGS. 4 and 6, the distance in the sliding direction between each through hole 131 and the corresponding flow channel 113 is constant. Therefore, the plurality of through holes 131 begin to overlap the corresponding flow channels 113 at the same timing. Moreover, since the shapes and the areas of the plurality of through holes 131 are equal to each other, the time and the area at which each through hole 131 overlaps the flow channel 113 become equal.

When the flow channels 113 and the storage portion 122 are brought into communication, the refrigerant in the storage portion 122 flows into each flow channel 113 through the through hole 131. The refrigerant flown into the flow channel 113 is ejected from the upper end 1132 of the flow channel 113 that opens at the top surface 11Aa of the punch part 11A or the upper surface 11Ba of the flange part 11B. The refrigerant flown into the flow channel 113 in the punch part 11A may also be ejected from the front end 1133 of the branch flow channel 1131.

The refrigerant ejected from the flow channels 113 and the branch flow channels 1131 of the die body 11 flows on the forming surface 111. On the forming surface 111, for example, a large number of fine convex portions are provided at approximately equal density, and the refrigerant flows between the convex portions. Thus, the refrigerant is supplied to the formed article and the formed article is cooled.

The refrigerant which has cooled the formed article flows into the flow channels 114 and the branch flow channels 1141 of the die body 11, and flows down in each flow channel 114. The refrigerant passes through each through hole 132 of the opening/closing member 13 and the through path 126 of the die base 12, and reaches the discharge portion 123, thereafter being discharged to the outside of the die 10.

When stopping the supply of refrigerant to the formed article, the opening/closing member 13 is moved to the other side in the sliding direction. Thereby, the opening/closing member 13 is returned from a state in which the through holes 131 overlap the flow channels 113, and the flow channels 113 and the storage portion 122 are in communication with each other (FIGS. 5 and 6), to a state in which the through holes 131 have deviated from the flow channels 113, and the flow channels 113 and the storage portion 122 are not in communication with each other (FIGS. 3 and 4). Note that, while the opening/closing member 13 is moving, the refrigerant pressure feeding means for supplying refrigerant to the storage portion 122 and the refrigerant suction means for sucking the refrigerant from the discharge portion 123 remain being driven. By leaving the refrigerant pressure feeding means in a driving state and having the storage portion 122 wait in a state of being filled with refrigerant, the supply amount of the refrigerant to the flow channels 113 and the timing at which refrigerant is ejected from the flow channels 113 can be stabilized.

Advantageous Effects

In the die 10 according to the first embodiment, the storage portion 122 in which refrigerant is stored is formed at the surface 121 of the die base 12. Therefore, it is not necessary to provide a cavity for storing refrigerant in the die body 11. Therefore, the strength of the die 10 can be secured.

In the die 10 according to the first embodiment, the opening/closing member 13 having the plurality of through holes 131 formed is disposed between the die base 12 and the die body 11. The through holes 131 of the opening/closing member 13 are arranged, for example, at the equal intervals as that of the flow channels 113 in the longitudinal direction and the lateral direction. By simply moving the opening/closing member 13, it is possible to switch a communication state and a non-communication state between the flow channels 113 of the die body 11 and the storage portion 122 of the die base 12. In a communication state, the refrigerant in the storage portion 122 flows into the flow channels 113 and is ejected from the forming surface 111. Therefore, according to the die 10, the refrigerant can be easily supplied from the die 10 to the formed article without performing complicated control by a plurality of valves.

In the first embodiment, the opening/closing member 13 has a plate shape, and slides in the lateral direction of the die 10. The opening/closing member 13 slides in the horizontal direction with respect to the die body 11 outside the die body 11. By sliding the opening/closing member 13, all through holes 131 formed in the opening/closing member 13 can be moved, and the plurality of flow channels 113 corresponding to the through holes 131 and the storage portion 122 can be brought into communication. Therefore, refrigerant can be ejected uniformly from the plurality of flow channels 113.

In the first embodiment, in the opening/closing member 13, each of the plurality of through holes 131 has a circular shape. However, in the first embodiment, the plurality of through holes 131 may include through holes having different shapes from each other.

Figure 7:
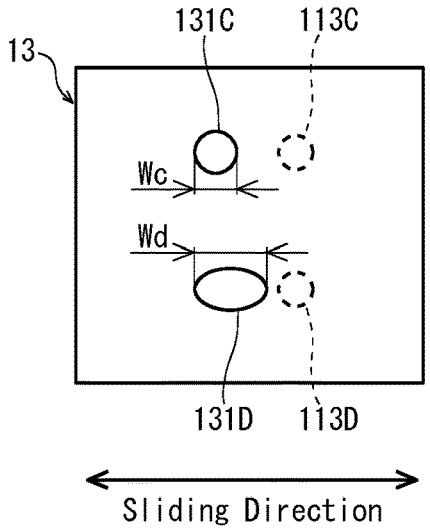
FIG. 7 is a schematic diagram for explaining overlapping between a through hole and a flow channel, which have different widths from each other in the sliding direction.

For example, as shown in FIG. 7, the plurality of through holes 131 may include a circular through hole 131C and an elliptic through hole 131D having a major diameter in the sliding direction. In the sliding direction, the width (opening length) Wd of the through hole 131D is larger than the width (opening length) We of the through hole 131C.

Figure 8:
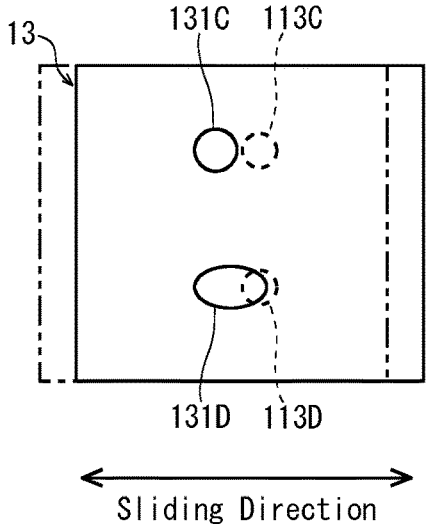
FIG. 8 is a schematic diagram for explaining overlapping between a through hole and a flow channel, which have different widths from each other in the sliding direction.
Figure 9:
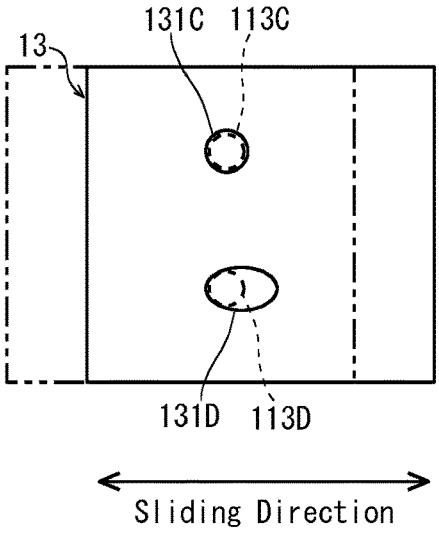
FIG. 9 is a schematic diagram for explaining overlapping between a through hole and a flow channel, which have different widths from each other in the sliding direction.

Referring to FIG. 7, in the initial state, both the through holes 131C and 131D do not overlap the corresponding flow channels 113C and 113D, and are in non-communication state. In the sliding direction, the positions of the ends of the through holes 131C and the through holes 131D, which are farther from the flow channels 113C and 113D, correspond to each other. When the opening/closing member 13 is slid from this state to one side in the sliding direction, as shown in FIG. 8, the elliptic through hole 131D first overlaps the flow channel 113D, resulting in a communication state. On the other hand, at this time, the circular through hole 131C does not overlap the flow channel 113C. When the opening/closing member 13 is further slid, as shown in FIG. 9, the through hole 131C also overlaps the flow channel 113C, resulting in a communication state.

When returning the through holes 131C and 131D to a non-communication state, the opening/closing member 13 is slid to the other side in the sliding direction. When the opening/closing member 13 is slid to the other side in the sliding direction, the through hole 131C first deviates from the flow channel 113C, resulting in a non-communication state (FIG. 8), and then the through hole 131D deviates from the flow channel 113D, resulting in a non-communication state (FIG. 7).

Thus, since the width Wd in the sliding direction of the through hole 131D is larger than the width We in the sliding direction of the through hole 131C, the time for which the through hole 131D is overlapping the flow channel 113D is longer than the time for which the through hole 131C is overlapping the flow channel 113C. Therefore, the flow channel 113D has a longer communication time with the storage portion 122 (FIG. 5) than the flow channel 113C. Therefore, it is possible to increase the supply time of refrigerant from the flow channel 113D to the formed article.

Figure 10:
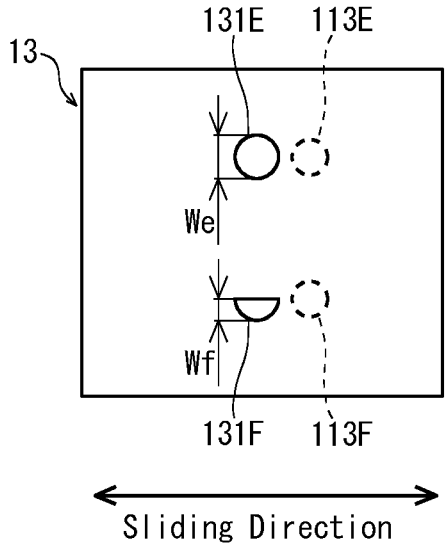
FIG. 10 is a schematic diagram for explaining overlapping between a through hole and a flow channel, which have different widths from each other in a direction perpendicular to the sliding direction.

For example, as shown in FIG. 10, in a direction perpendicular to the sliding direction, the width (opening length) We of the through hole 131E may be larger than the width (opening length) Wf of the through hole 131F. For example, the through hole 131E may have a circular shape, and the through hole 131F may have a semicircular shape.

Figure 11:
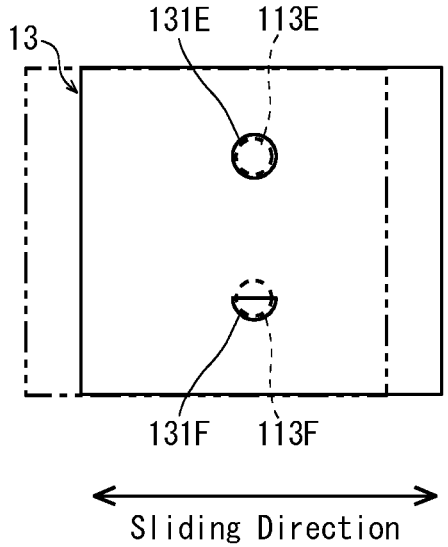
FIG. 11 is a schematic diagram for explaining overlapping between a through hole and a flow channel, which have different widths from each other in a direction perpendicular to the sliding direction.

Referring to FIG. 10, in the initial state, both the through holes 131E and 131F do not overlap the corresponding flow channels 113E and 113F, and are in a non-communication state. The positions in the sliding direction of the through hole 131E and the through hole 131F coincide with each other. When the opening/closing member 13 is slid from this state to one side in the sliding direction, as shown in FIG. 11, the through holes 131E and 131F simultaneously overlap the flow channels 113E and 113F, resulting in a communication state. When the opening/closing member 13 is moved to the other side in the sliding direction, the through holes 131E and 131F simultaneously deviate from the flow channels 113E and 113F, resulting in a non-communication state (FIG. 10). However, the area in which the through hole 131E and the flow channel 113E overlap is larger than the area in which the through hole 131F and the flow channel 113F overlap. Therefore, the flow rate per unit time of the refrigerant supplied from the flow channel 113E to the formed article can be increased to more than the flow rate per unit time of the refrigerant supplied from the flow channel 113F to the formed article.

Figure 12:
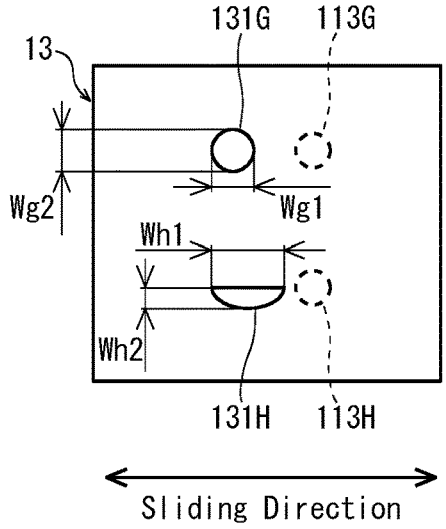
FIG. 12 is a schematic diagram for explaining overlapping between a through hole and a flow channel, which have different widths from each other in the sliding direction and a direction perpendicular to the sliding direction.

Moreover, for example, as shown in FIG. 12, in the sliding direction, the width (opening length) Wh1 of the through hole 131H may be larger than the width (opening length) Wg1 of the through hole 131G. In the direction perpendicular to the sliding direction, the width (opening length) Wg2 of the through hole 131G may be larger than the width (opening length) Wh2 of the through hole 131H. For example, the through hole 131G may have a circular shape, and the through hole 131H may have a semi-elliptic shape.

Figure 13:
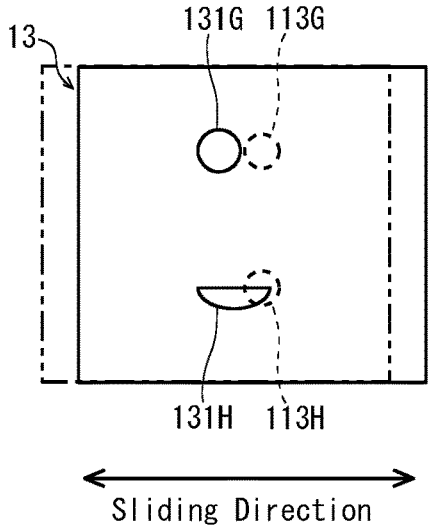
FIG. 13 is a schematic diagram for explaining overlapping between a through hole and a flow channel, which have different widths from each other in the sliding direction and a direction perpendicular to the sliding direction.
Figure 14:
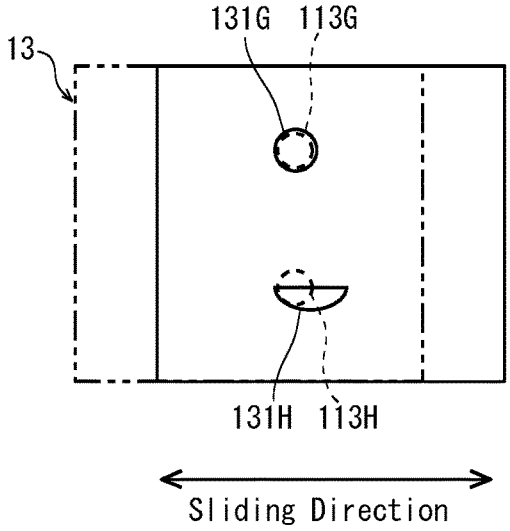
FIG. 14 is a schematic diagram for explaining overlapping between a through hole and a flow channel, which have different widths from each other in the sliding direction and a direction perpendicular to the sliding direction.

Referring to FIG. 12, in the initial state, both of the through holes 131G and 131H do not overlap the corresponding flow channels 113G and 113H, and are in a non-communication state. In the sliding direction, the positions of the ends of the through hole 131G and the through hole 131H, which are farther from the flow channels 113G and 113H, coincide with each other. When the opening/closing member 13 is slid from this state to one side in the sliding direction, the through hole 131H first overlaps the flow channel 113H as shown in FIG. 13. On the other hand, at this time, the through hole 131G does not overlap the flow channel 113G. When the opening/closing member 13 is further slid, as shown in FIG. 14, the through hole 131G also overlaps the flow channel 113G. When the opening/closing member 13 is slid to the other side in the sliding direction, the through hole 131G first deviates from the flow channel 113G, resulting in a non-communication state (FIG. 13), and then the through hole 131H deviates from the flow channel 113H, resulting in a non-communication state (FIG. 12).

Since the width Wh1 in the sliding direction of the through hole 131H is larger than the width Wg1 in the sliding direction of the through hole 131G, the flow channel 113H has a longer communication time with the storage portion 122 (FIG. 5) than the flow channel 113G. Therefore, it is possible to increase the supply time of refrigerant from the flow channel 113H to the formed article. On the other hand, the area where the through hole 131G and the flow channel 113G overlap is larger than the area where the through hole 131H and the flow channel 113H overlap. Therefore, the flow rate per unit time of the refrigerant supplied from the flow channel 113G to the formed article can be increased to more than the flow rate per unit time of the refrigerant supplied from the flow channel 113H to the formed article.

Thus, at each through hole 131 of the opening/closing member 13, by changing the width in the sliding direction, it is possible to adjust the supply time of refrigerant to the formed article for each through hole 131. At each through hole 131, by changing the width in the direction perpendicular to the sliding direction, it is possible to adjust the flow rate per unit time of the refrigerant supplied to the formed article for each through hole 131. Therefore, the cooling time, cooling speed, and the like can be appropriately set for each part of the formed article.

For example, when it is desired that, in the formed article, the portion to be formed by a side surface 11Ab of the punch part 11A is cooled more harshly than other portions, the width of the through hole 131 corresponding to the flow channel 113 which opens at the side surface 11Ab may be made larger than the width of other through holes 131 in the sliding direction and/or the direction perpendicular to the sliding direction. When it is desired that, in the formed article, the portion to be formed by a flange part 11B is cooled more weakly than the other portions, the width of the through hole 131 corresponding to the flow channel 113 of the flange part 11B may be made smaller than the width of other through holes 131 in the sliding direction and/or the direction perpendicular to the sliding direction.

FIGS. 7 to 14 show, for the sake of convenience of explanation, two types of through holes 131 having different widths in the sliding direction and/or the direction perpendicular to the sliding direction. However, the opening/closing member 13 may also be provided with three or more types of through holes 131 having different widths in the sliding direction and/or the direction perpendicular to the sliding direction. By efficiently providing a plurality of types of through holes 131 in the opening/closing member 13, it is possible to efficiently perform ejection control of the refrigerant from the plurality of flow channels 113.

In the example shown in FIGS. 7 to 14, the opening/closing member 13 is moved to one side in the sliding direction so that the through holes 131 are overlapped with the flow channels 113 into a communication state, and thereafter the opening/closing member 13 is moved to the other side in the sliding direction to return it to the initial position so that the through holes 131 are brought into a non-communication state. However, the through holes 131 may be brought into a non-communication state by, after moving the opening/closing member 13 to one side in the sliding direction so that the through holes 131 are overlapped with the flow channels 113 thereby being brought into a communication state, keeping on the through holes 131 to move passing the flow channels 113. Next, when bringing the through holes 131 into a communication state, the opening/closing member 13 may be moved to the other side in the sliding direction. In other words, by moving the opening/closing member 13 to the other side in the sliding direction, the through holes 131 in a non-communication state are made to overlap the flow channels 113, thus being brought into a communication state. Thereafter, by moving the opening/closing member 13 further to the other side in the sliding direction and returning it to the initial position, the through holes 131 pass the flow channels 113 and are brought into a non-communication state. When returning the opening/closing member 13 to the initial position, in order to suppress the ejection of the refrigerant from the die, supply of refrigerant may be stopped by stopping a refrigerant supply unit (refrigerant pressure feeding means), closing the valve provided in the refrigerant supply portion of the refrigerant supply unit, or the like.

In the first embodiment, the storage portion 122 of the die base 12 is configured by the plurality of grooves 124, 125 provided at the surface 121. In the storage portion 122, one or more island-like portions surrounded by the grooves 124, 125, in other words, one or more portions that protrude from the bottom surface of the concave storage portion 122 to come into contact with the opening/closing member 13 are formed. For that reason, for example, the storage amount of refrigerant in the storage portion 122 can be reduced compared with the case in which the storage portion 122 is a single concave portion without the island-like portion. Therefore, when supply of refrigerant to the storage portion 122 is started without the storage portion 122 being filled with refrigerant, it is possible to reduce the time from when the supply of the refrigerant to the storage portion 122 is started until when the refrigerant is allowed to flow into each flow channel 113 of the die body 11. On the other hand, when the supply of the refrigerant to the storage portion 122 is started with the storage portion 122 being already filled with the refrigerant, good responsiveness of the refrigerant pressure (the performance that the refrigerant in the storage portion 122 flows into each flow channel 113 in response to the start of supply of refrigerant to the storage portion 122) can be ensured. In other words, in the case of a storage portion 122 having an island-like portion surrounded by the grooves 124, 125, even if the supply flow rate of refrigerant does not change, the responsiveness of refrigerant pressure can be improved compared to the storage portion 122 without an island-like portion. In addition to this, even when the surface position (water level) of the refrigerant in the storage portion 122 has been lowered before the refrigerant is supplied, the time fluctuation until the refrigerant can flow into each flow channel 113 of the die body 11 can be suppressed.

Further, by configuring the storage portions 122 by bringing the plurality of grooves 124, 125 into communication with each other, it is possible to integrate piping systems to be connected to the die base 12, and expand the diameter of the pipe connected to the die base 12. Therefore, it is possible to suppress the pressure loss of the refrigerant to be supplied to the storage portion 122. Furthermore, it is possible to compensate the decrease in the flow rate of refrigerant in the communication portion between each flow channel 113 of the die body 11 and the storage portion 122, and stabilize the flow rate of refrigerant ejected from the forming surface 111 through the flow channels 113. Similarly, if the discharge portion 123 is configured by a plurality of grooves in communication with each other, it is possible to integrate piping systems on the discharge side and expand the diameter of the pipe connected to the die base 12, thereby allowing to suppress the pressure loss of the refrigerant ejected from the discharge portion 123. Moreover, it is possible to compensate decrease in the flow rate of refrigerant in the communication portion between each flow channel 114 of the die body 11 and the discharge portion 123, and stabilize the flow rate of refrigerant discharged from the discharge portion 123 through the flow channels 114.

In the first embodiment, the grooves 124, 125 of the die base 12 are provided so as to be in communication with each other and correspond to the plurality of through holes 131 of the opening/closing member 13. This makes it possible to uniformize the pressure distribution of the refrigerant flowing from the grooves 124, 125 into the flow channels 113 of the die body 11 through the through holes 131.

In the first embodiment, since the refrigerant storage portion 122 is formed in the die base 12, it is not necessary to make a cavity in the die body 11 which is dependent on the shape of the formed article, and also it is not necessary to prepare a container for the refrigerant according to the shape of the cavity. Therefore, the production of the die body 11 becomes easy. Further, providing the refrigerant storage portion 122 in the die base 12 makes it possible to share the die base 12 with a plurality of types of die bodies 11.

For example, if the pitch of the flow channels 113 in the lateral direction of the die body 11 is set to an integer multiple of the pitch of the grooves 124 of the die base 12, no matter which die body 11 is mounted to the die base 12, each flow channel 113 faces the groove 124. Therefore, one die base 12 can be shared by a plurality of types of die bodies 11.

In the first embodiment, ejection control of refrigerant is performed by the opening/closing member 13 disposed between the die body 11 and the die base 12. Since the opening/closing member 13 is separate from the die body 11 and the die base 12, it is possible to replace it appropriately. In other words, it is also possible to exchange the opening/closing member 13 of the die 10 with another opening/closing member 13 in which the through holes 131 are located differently. Thereby, the flow channels 113 of the die body 11 can be selectively used.

In the first embodiment, an example in which the die 10 includes one opening/closing member 13 has been described, but the number of the opening/closing members 13 is not particularly limited. The die 10 can also include a plurality of opening/closing members 13 as necessary. For example, in the die 10, a plurality of opening/closing members 13 may be placed in parallel on the surface 121 of the die base 12. These opening/closing members 13 slide, for example, in the same direction on the surface 121 of the die base 12.

Second Embodiment

Figure 15:
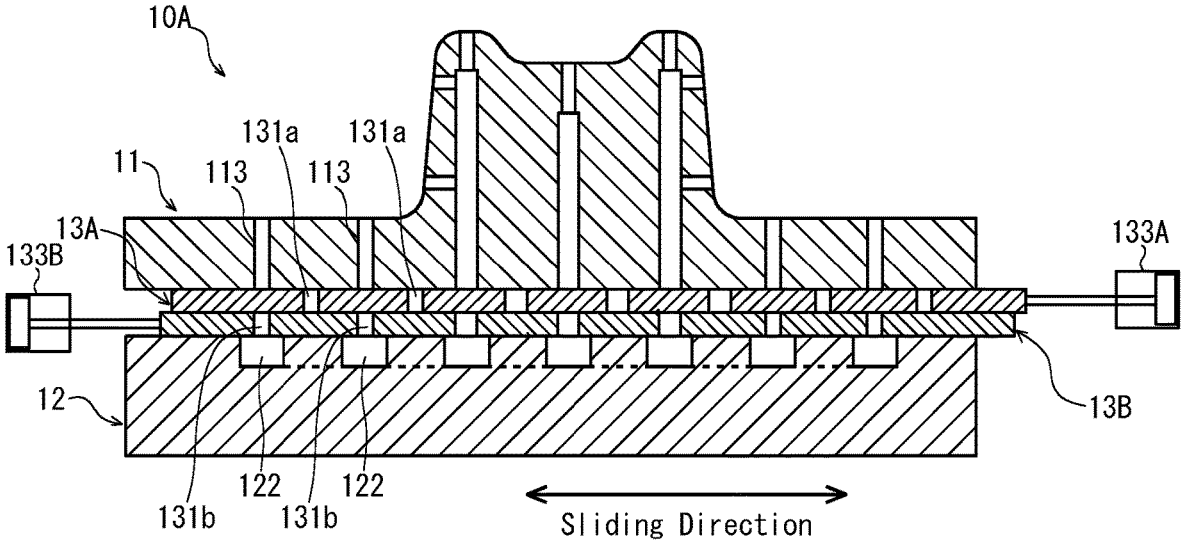
FIG. 15 is a sectional view in a plane perpendicular to the longitudinal direction of a die according to a second embodiment.

FIG. 15 is a sectional view (cross section view) in a plane perpendicular to the longitudinal direction of the die 10A according to a second embodiment. The die 10A according to the second embodiment differs from the die 10 according to the first embodiment in the configuration of the opening/closing member. In FIG. 15, only the flow channels 113 on the refrigerant supply side are shown, and the flow channels 114 on the refrigerant discharge side are omitted.

As shown in FIG. 15, the die 10A includes a plurality of opening/closing members 13A and 13B. Each of the opening/closing members 13A and 13B has a solid plate shape. The opening/closing members 13A and 13B are members separate from the die body 11 and are disposed outside the die body 11. More specifically, the opening/closing members 13A and 13B are disposed between the die base 12 and the die body 11. The opening/closing member 13A is placed on the opening/closing member 13B. The opening/closing members 13A and 13B are provided with driving units 133A and 133B, respectively. The opening/closing members 13A and 13B slide independently in the lateral direction of the die 10A. The opening/closing member 13A includes a plurality of through holes 131*a*. The opening/closing member 13B includes a plurality of through holes 131*b*. Referring to FIGS. 16 to 19, the operation of the opening/closing members 13A and 13B will be described.

Figure 16:
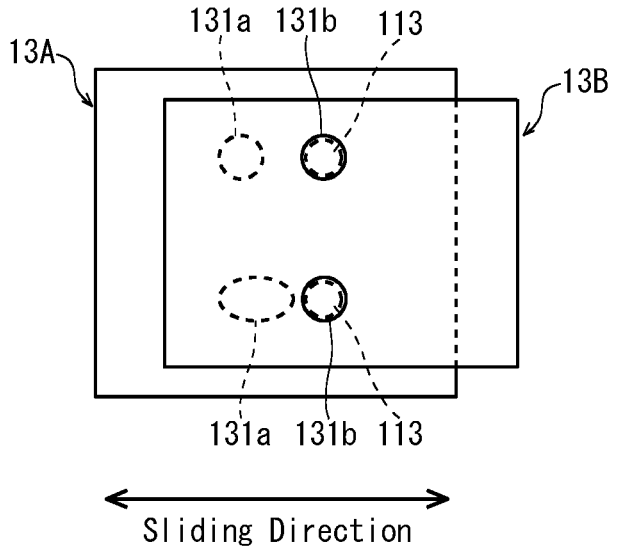
FIG. 16 is a schematic diagram for explaining overlapping between a through hole of the opening/closing member and a flow channel of the die body in the second embodiment.
Figure 17:
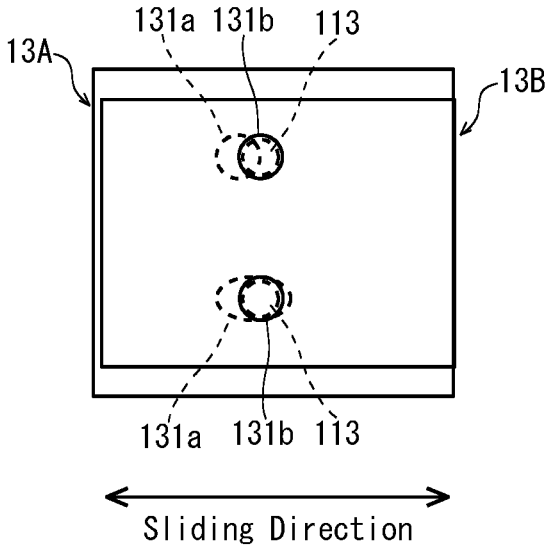
FIG. 17 is a schematic diagram for explaining overlapping between a through hole of the opening/closing member and a flow channel of the die body in the second embodiment.
Figure 18:
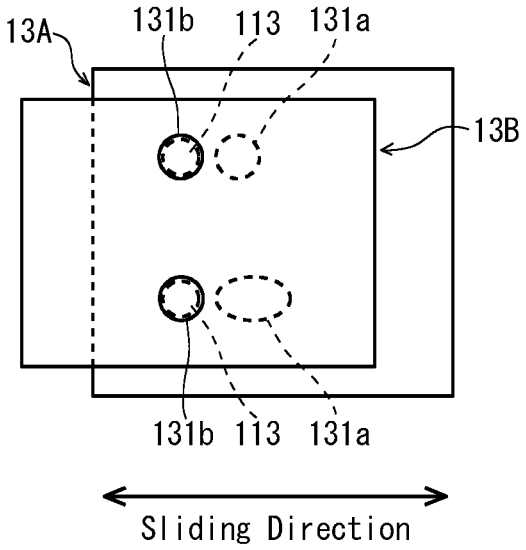
FIG. 18 is a schematic diagram for explaining overlapping between a through hole of the opening/closing member and a flow channel of the die body in the second embodiment.

As shown in FIG. 16, before cooling the formed article, the through holes 131*b* of the opening/closing member 13B overlap the flow channels 113. On the other hand, since the through holes 131*a* of the opening/closing member 13A do not overlap the flow channels 113, the flow channels 113 are blocked by the opening/closing member 13A. From this state, when the driving unit 133A is driven and the opening/closing member 13A is slid to one side in the sliding direction, the through holes 131*a* overlap the flow channels 113 as shown in FIG. 17. Therefore, the flow channels 113 and the storage portion 122 (FIG. 15) are brought into a communication state, and the refrigerant in the storage portion 122 is ejected from the upper end of each flow channel 113. When the opening/closing member 13A is further slid, as shown in FIG. 18, the through holes 131*a* pass the flow channels 113, and the flow channels 113 are blocked by the opening/closing member 13A. This ends the supply of refrigerant to the formed article.

Figure 19:
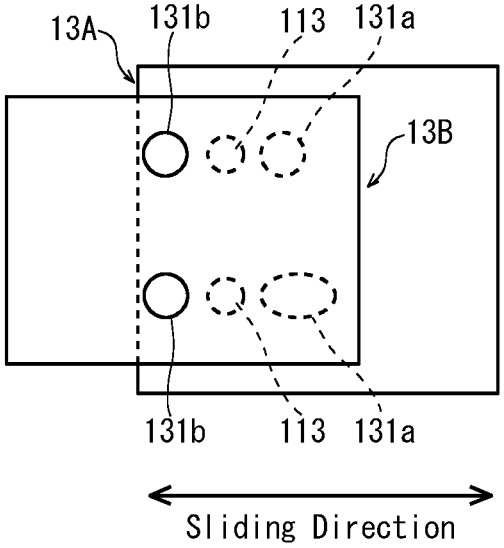
FIG. 19 is a schematic diagram for explaining overlapping between a through hole of the opening/closing member and a flow channel of the die body in the second embodiment.
Figure 20:
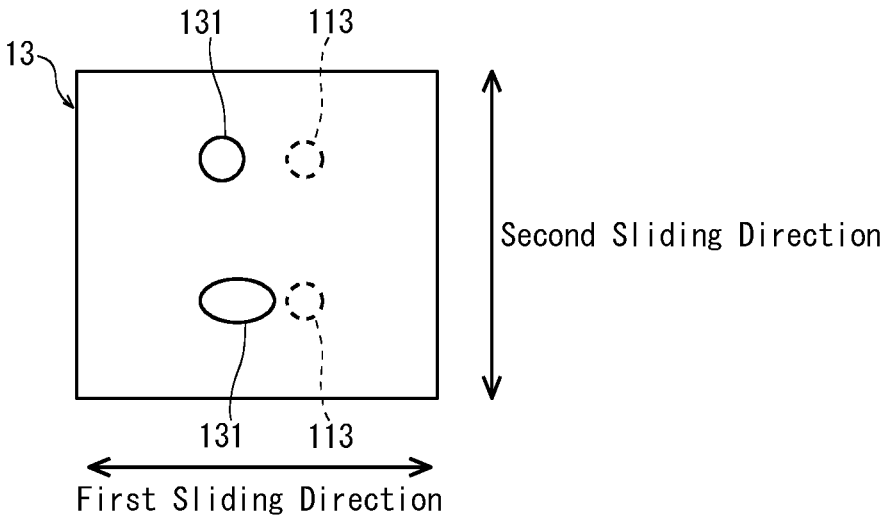
FIG. 20 is a schematic diagram for explaining overlapping between a through hole of the opening/closing member and a flow channel of the die body in another example of the second embodiment.

When returning the opening/closing member 13A to the initial position and entering the preparation for press working of a new blank, the opening/closing member 13B is slid to the other side in the sliding direction by driving the driving unit 133B while the opening/closing member 13A is stopped. As a result, as shown in FIG. 19, the through holes 131*b* of the opening/closing member 13B become not overlapping the flow channels 113. Thereafter, the opening/closing member 13A is slid to the other side and is returned to the initial position. At this time, since the opening/closing member 13A follows the same path to return to the original position, the through holes 131*a* of the opening/closing member 13A overlap the flow channels 113. However, since the flow channels 113 are blocked by the opening/closing member 13B, the flow channels 113 and the storage portion 122 (FIG. 15) remain in a non-communication state. After the opening/closing member 13A returns to the original position, the opening/closing member 13B is returned to the original position. At this time, since the flow channels 113 are blocked by the opening/closing member 13A, the flow channels 113 and the storage portion 122 remain in a non-communication state.

Thus, by using the two opening/closing members 13A and 13B, it is possible to return the opening/closing members 13A and 13B to the initial positions while the flow channel 113 and the storage portion 122 are maintained in a non-communication state, after the supply of refrigerant to the formed article is completed. In other words, it is possible to return the opening/closing members 13A and 13B to the initial positions without the refrigerant being ejected from the flow channels 113 even if any countermeasure such as stopping the refrigerant pressure feeding means is not taken. Therefore, for example, even when the timing of starting the ejection of refrigerant from the flow channel 113 is different among the plurality of through holes 131*a*, the timing of stopping the ejection of refrigerant can be made to coincide among these through holes 131*a*. In other words, by using the two opening/closing members 13A and 13B, it is possible to independently control the timing of starting the ejection of refrigerant and the timing of stopping the ejection of refrigerant.

Figure 21:
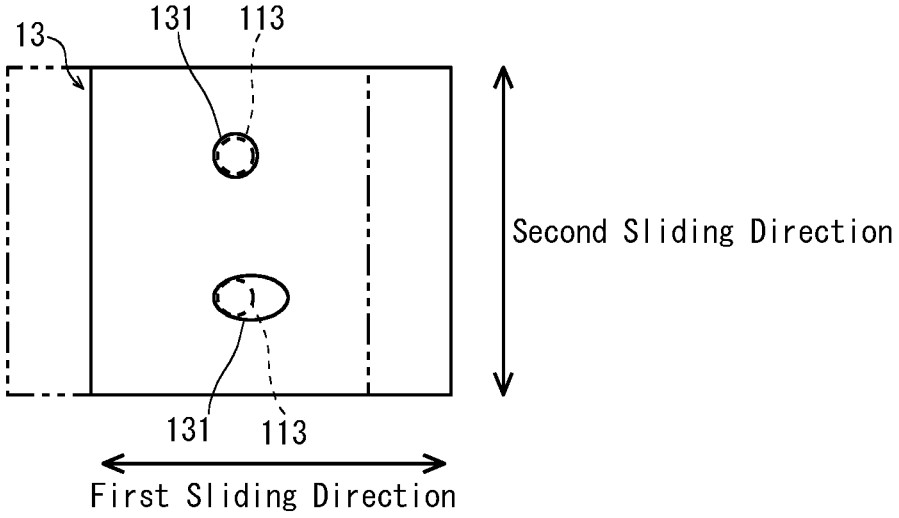
FIG. 21 is a schematic diagram for explaining overlapping between a through hole of the opening/closing member and a flow channel of the die body in another example of the second embodiment.
Figure 22:
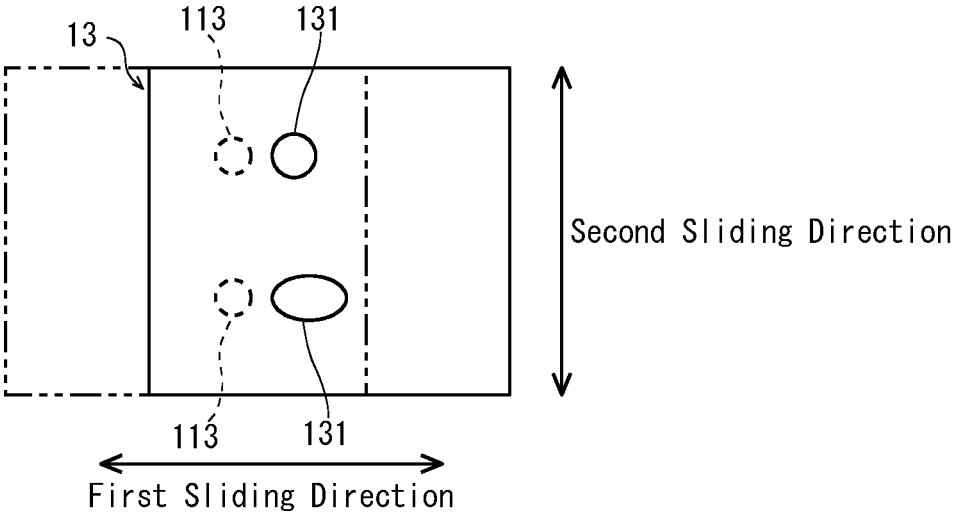
FIG. 22 is a schematic diagram for explaining overlapping between a through hole of the opening/closing member and a flow channel of the die body in another example of the second embodiment.
Figure 23:
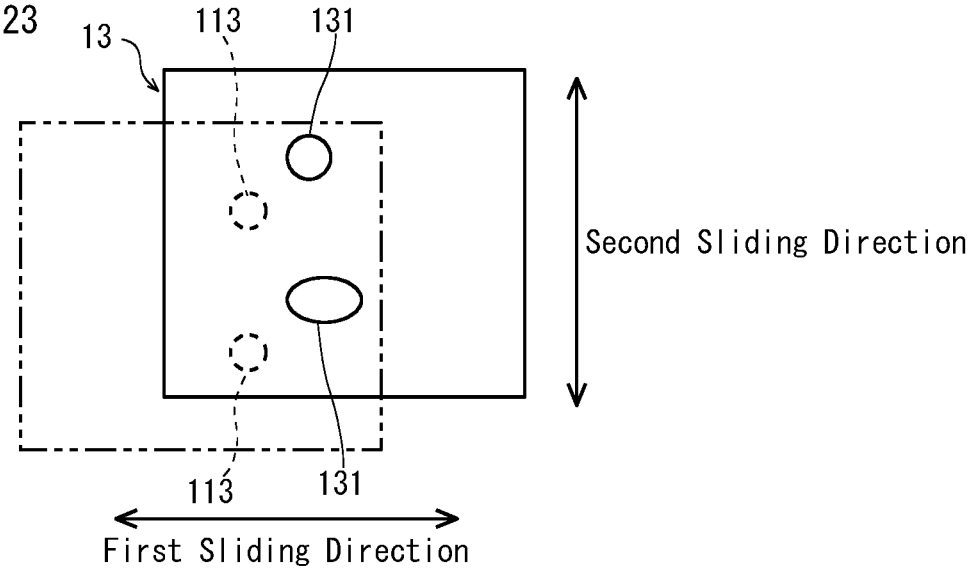
FIG. 23 is a schematic diagram for explaining overlapping between a through hole of the opening/closing member and a flow channel of the die body in another example of the second embodiment.

The opening/closing member 13 can also be slidable in two axial directions. For example, as shown in FIGS. 20 to 23, the opening/closing member 13 may be configured to slide in a first sliding direction, and in a second sliding direction different from the first sliding direction. Here, description will be made on a case in which the second sliding direction is perpendicular to the first sliding direction. In this case, when cooling the formed article, the opening/closing member 13 is moved to one side in the first sliding direction (FIG. 20) so as to cause the through holes 131 to overlap the flow channels 113 (FIG. 21). When the opening/closing member 13 is further slid, the through holes 131 pass the flow channels 113, and the flow channels 113 are blocked by the opening/closing member 13 (FIG. 22). As a result of this, the supply of refrigerant to the formed article will end.

The moving path of the opening/closing member 13 when the opening/closing member 13 is returned to the initial position after the supply of refrigerant is ended is different from the moving path (FIGS. 21 and 22) of the opening/closing member 13 when the supply of refrigerant is performed. When returning the opening/closing member 13 to the initial position, the opening/closing member 13 is moved to one side in the second sliding direction (FIG. 23), and is thereafter moved to the other side in the first sliding direction. At this time, the through holes 131 of the opening/closing member 13 do not overlap the flow channels 113. Finally, by moving the opening/closing member 13 to the other side in the second sliding direction, the opening/closing member 13 is returned to the position of FIG. 20.

Thus, even when one opening/closing member 13 is made slidable in two axial directions, it is possible to return the opening/closing member 13 to the initial position while the flow channels 113 and the storage portion 122 are maintained in a non-communication state, after the supply of refrigerant to the formed article is ended. In other words, even without taking any countermeasure such as stopping the refrigerant pressure feeding means, it is possible to return the opening/closing member 13 to the initial position without the refrigerant being ejected from the flow channels 113. Therefore, for example, even when the timing of starting the ejection of refrigerant from the flow channel 113 is different among the plurality of through holes 131, the timing of stopping the ejection of the refrigerant can be made to coincide among these through holes 131. In other words, by sliding the opening/closing member 13 in two axial directions, it is possible to independently control the timing of starting the ejection of refrigerant and the timing of stopping the ejection of refrigerant.

Although embodiments according to the present disclosure have been described so far, the present disclosure will not be limited to the above described embodiments, and various modifications can be made as long as they do not depart from the spirit thereof.

Figure 24:
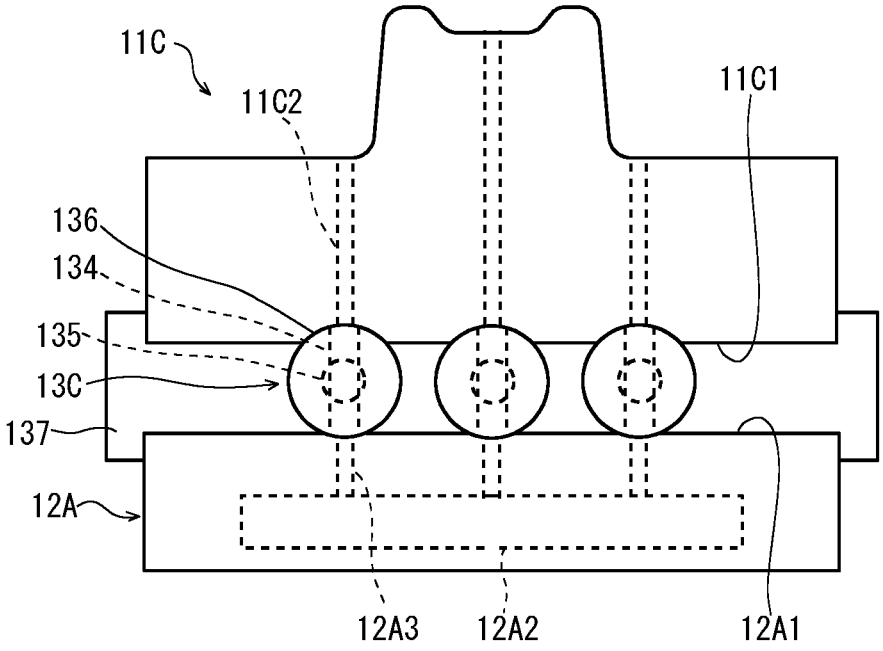
FIG. 24 is a schematic diagram showing another example of the opening/closing member.

In the above described first embodiment, the opening/closing member 13 has a plate shape. However, the opening/closing member 13 may not have a plate shape. For example, as shown in FIG. 24, the opening/closing member 13C may include, in addition to a plurality of through holes 134, rotating shafts 135 and cylindrical members 136 that each rotate integrally with the corresponding rotating shaft 135. Both ends of the rotating shafts 135 are rotatably mounted to a support member 137. Each through hole 134 passes through the corresponding cylindrical member 136 and rotating shaft 135 in the vertical direction.

The cylindrical member 136 and the rotating shaft 135 extend in the longitudinal direction between the die base 12A and the die body 11C. The outer peripheral surface of the cylindrical member 136 is in contact with a concave portion formed at the mounting surface 11C1 of the die body 11C and a concave portion formed at the surface 12A1 of the die base 12A. The flow channel 11C2 opens in the concave portion of the mounting surface 11C1. A supply tube 12A3 extending upward from the storage portion 12A2 opens in the concave portion of the surface 12A1 of the die base 12A.

When the through hole 134 of the opening/closing member 13C extends in the vertical direction, the upper end of the through hole 134 overlaps the flow channel 11C2 of the die body 11C, and the lower end of the through hole 134 overlaps the supply tube 12A3 extending from the storage portion 12A2 of the die base 12A. Therefore, the flow channel 11C2 and the storage portion 12A2 are brought into a communication state. From this state, when the rotating shaft 135 and the cylindrical member 136 are rotated by the driving unit (not illustrated), the through hole 134 deviates from the flow channel 11C2 and the supply tube 12A3, and the flow channel 11C2 and the storage portion 12A2 are brought into a non-communication state. Therefore, even in such a configuration, the flow channel 11C2 and the storage portion 12A2 can be switched to a communication state or a non-communication state.

In each of the above described embodiments, the flow channels 113 of the die body 11 and the storage portion 122 of the die base 12 are brought into communication by sliding the plate-shaped opening/closing member 13 in one or two axial directions. However, the flow channels 113 and the storage portion 122 may be brought into communication by rotating the plate-shaped opening/closing member 13 with the vertical direction as the center axis.

In each of the above described embodiments, the opening/closing member 13 is placed at the middle part in the longitudinal direction of the die base 12, and the die body 11 is supported only by both ends in the longitudinal direction of the die base 12. However, the die body 11 can also be supported by both ends in the longitudinal direction of the die base 12 and the intermediate portion thereof. In other words, one or more intermediate supporting portions for supporting the die body 11 can be provided between ends in the longitudinal direction of the die base 12. When an intermediate supporting portion is provided in the die base 12, for example, the opening/closing member 13 can be divided into a plurality of pieces at the position of the intermediate supporting portion. Alternatively, an opening portion can be provided in the portion corresponding to the intermediate supporting portion of the opening/closing members 13. To allow sliding of the opening/closing member 13, the length of the opening portion in the sliding direction is sufficiently larger than the length of the intermediate supporting portion.

In each of the above described embodiments, the storage portion 122 includes the plurality of grooves 124 extending in a direction perpendicular to the sliding direction of the opening/closing member 13. However, the grooves 124 may not necessarily extend in the direction perpendicular to the sliding direction. The grooves 124 may extend in the sliding direction or may be inclined with respect to the sliding direction.

In each of the above described embodiments, the storage portion 122 is configured by the grooves 124 and 125 which are in communication with each other. However, the storage portion 122 may not be configured by the grooves 124 and 125. For example, the storage portion 122 may simply be a concave space.

In each of the above described embodiments, the flow channels 113 of the die body 11 are used as supply flow channels of refrigerant, and the flow channels 114 are used as discharge flow channels of refrigerant. However, conversely, the flow channels 114 of the die body 11 can be used as supply flow channels of refrigerant and the flow channels 113 as discharge flow channels of refrigerant. In this case, the storage portion 122 of the die base 12 functions as a discharge portion, and the discharge portion 123 functions as a storage portion.

In each of the above described embodiments, the storage portion 122 is provided at the surface 121 on the die body 11 side in the die base 12, and the discharge portion 123 is provided at the surface on the opposite side. However, both the storage portion 122 and the discharge portion 123 can be formed at the surface 121 on the die body 11 side. For example, on the surface 121 of the die base 12, the grooves (lateral grooves) constituting the storage portion 122 and the grooves (lateral grooves) constituting the discharge portion 123 can be alternately arranged. It is preferable that the lateral grooves of the storage portion 122, as well as the lateral grooves of the discharge portion 123 are in communication with each other through a groove (longitudinal groove) extending in the arrangement direction, respectively. In each of the storage portions 122 and the discharge portion 123, the longitudinal grooves may connect the ends of the lateral grooves arranged in one direction, or may connect middle parts of each lateral groove. For example, when the longitudinal grooves connect the middle parts of each lateral groove at the discharge portion 123, each lateral groove of the storage portion 122 is divided by the longitudinal groove of the discharge portion 123.

In each of the above described embodiments, the die body 11 has an approximately hat shape viewed from the longitudinal direction. However, the die body 11 is not limited thereto. The die body 11 may have a shape corresponding to various formed articles produced by hot pressing.

In each of the above described embodiments, refrigerant is supplied from the die 10, 10A which is the lower die. However, the refrigerant may be supplied not only from the die 10, 10A but also from the die 20 (FIG. 1), which is the upper die. In this case, the die 20 preferably has a configuration similar to that of the die 10, 10A.

Figure 25:
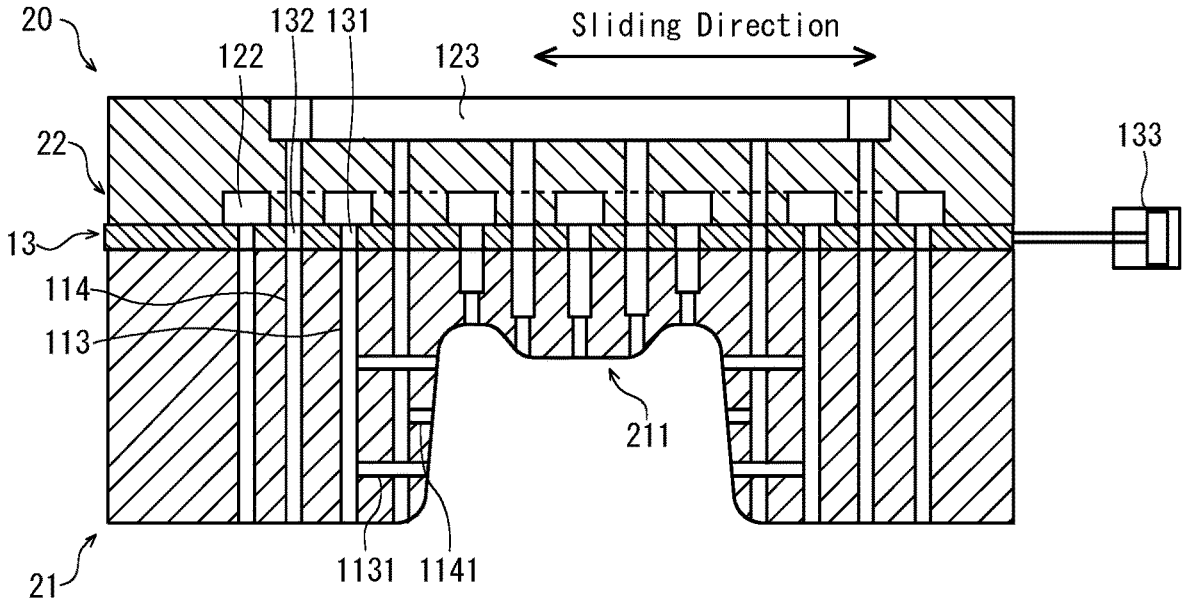
FIG. 25 is a sectional view in a plane perpendicular to the longitudinal direction of the die in another example of the embodiments.

That is, as shown in FIG. 25, the die 20 preferably has a configuration in which the opening/closing member 13 is disposed between the die body 21 and the die base 22. In the die body 21, as in the die body 11 of the die 10 (FIG. 3), flow channels 113, 114, and branch flow channels 1131, 1141 are provided. In the die base 22, as in the die base 12 of the die 10 (FIG. 3), a storage portion 122, and a discharge portion 123 are provided. The opening/closing member 13 is configured to be movable with respect to the die body 21 and the die base 22 such that each of through holes 131 brings the corresponding flow channel 113 of the die body 21 and the storage portion 122 of the die base 22 into communication. Further, each through hole 132 brings the corresponding flow channel 114 of the die body 21 and the discharge portion 123 of the die base 22 into communication. As a result of the storage portion 122 and the flow channels 113 being brought into communication, the refrigerant in the storage portion 122 is ejected from the forming surface 211 of the die body 21 through the flow channels 113. The refrigerant on the forming surface 211 is discharged from the die 20 through the flow channels 114 and the discharge portion 123.

REFERENCE SIGNS LIST

10, 10A, 20: Die
11, 11C, 21: Die body
111, 211: Forming surface
112, 11C1: Mounting surface
113, 113C to 113H, 11C2: Flow channel
12, 12A, 22: Die base
121, 12A1: Surface
122, 12A2: Storage portion
124, 125: Groove
13, 13A to 13C: Opening/closing member
131, 131C to 131H, 131*a*, 131*b*, 134: Through hole

The invention claimed is:

1. A die, comprising:

a die base including a storage portion for storing refrigerant formed therein;

a die body mounted to the die base, the die body including a mounting surface located on the storage portion side of the die base, a forming surface located on the opposite side of the mounting surface, and a plurality of flow channels passing through the die body from the mounting surface toward the forming surface;

an opening/closing member disposed between the die base and the die body, and including a plurality of through holes corresponding to the plurality of flow channels; and refrigerant pressure feeding means configured to supply the refrigerant to the storage portion, wherein the opening/closing member is configured to be movable with respect to the die base and the die body such that each of the through holes brings a corresponding flow channel and the storage portion into communication.

2. The die according to claim 1, wherein the opening/closing member has a plate shape, and slides with respect to the die base and the die body.

3. The die according to claim 2, wherein the plurality of through holes include a first through hole and a second through hole, and a width of the second through hole is larger than a width of the first through hole in a sliding direction of the opening/closing member and/or a direction perpendicular to the sliding direction.

4. The die according to claim 2, wherein the opening/closing member slides in two axial directions with respect to the die base and the die body.

5. The die according to claim 1, wherein the storage portion comprises a plurality of grooves, and the plurality of grooves are in communication with each other.

6. The die according to claim 3, wherein the opening/closing member slides in two axial directions with respect to the die base and the die body.

7. The die according to claim 2, wherein
the storage portion comprises a plurality of grooves, and
the plurality of grooves are in communication with each other.

8. The die according to claim 3, wherein
the storage portion comprises a plurality of grooves, and
the plurality of grooves are in communication with each other.

9. The die according to claim 4, wherein
the storage portion comprises a plurality of grooves, and
the plurality of grooves are in communication with each other.

10. The die according to claim 6, wherein
the storage portion comprises a plurality of grooves, and
the plurality of grooves are in communication with each other.

* * * * *